US005211490A

United States Patent [19]

Suzawa et al.

[11] Patent Number: 5,211,490

[45] Date of Patent: May 18, 1993

[54] INK RIBBON CASSETTE WITH RE-INKING AND DRIVE GEAR

[75] Inventors: Hiromichi Suzawa; Masaru Sugie; Masayuki Kubota; Chiaki Sekioka; Hiroki Ohta, all of Inagi, Japan

[73] Assignee: Fujitsu Isotec Limited, Tokyo, Japan

[21] Appl. No.: 798,718

[22] Filed: Nov. 27, 1991

[30] Foreign Application Priority Data

Nov. 30, 1990 [JP] Japan ..... 2-341004

[51] Int. Cl.[5] ..... B41J 27/12

[52] U.S. Cl. ..... 400/202.4; 400/235.1

[58] Field of Search ..... 400/197, 202.1, 202.2, 400/202.3, 202.4, 235.1

[56] References Cited

U.S. PATENT DOCUMENTS

| | | | |
|---|---|---|---|
| 4,343,556 | 8/1982 | Kobayashi | 400/235.1 |
| 4,616,942 | 10/1986 | Nagasawa et al. | 400/202.4 |
| 4,747,711 | 5/1988 | Motta et al. | 400/202.4 |
| 4,747,713 | 5/1988 | Kikuchi et al. | 400/202.4 |

FOREIGN PATENT DOCUMENTS

| | | | |
|---|---|---|---|
| 0210755A3 | 2/1987 | European Pat. Off. . | |
| 78881 | 5/1984 | Japan | 400/235.1 |
| 164179 | 9/1984 | Japan | 400/235.1 |
| 63-182174 | 7/1988 | Japan . | |
| 1-198379 | 8/1989 | Japan . | |

*Primary Examiner*—Edgar S. Burr
*Assistant Examiner*—Stephen R. Funk
*Attorney, Agent, or Firm*—Armstrong, Westerman, Hattori, McLeland & Naughton

[57] ABSTRACT

An inked ribbon cassette comprising an ink supply felt, a first gear arranged in contact with the felt and a second gear in engagement with the first gear. An ink ribbon is pinched between the first and the second gears and driven by the first and the second gears upon rotation thereof. Accordingly, ink is transferred from the felt to the first gear, and in turn, from the first gear to the ink ribbon. There are grooves in the first gear for containing ink therein ink is excessively transferred from the ink supply felt to the first gear. The grooves are preferably provided in bottom lands of the first gear by increasing the whole depth of the first gear.

2 Claims, 4 Drawing Sheets

INK RIBBON CASSETTE WITH RE-INKING AND DRIVE GEAR

BACKGROUND OF THE INVENTION

1. Field of the Invention

The present invention relates to an ink ribbon cassette used in a printer, a typewriter or the like.

2. Description of the Related Art

Several types of ink ribbon cassettes are used in many printers and typewriters. In thermal type printers, one-time disposable ink ribbon cassettes are generally used. In impact dot type printers, one type of ink ribbon cassette includes a relatively long, for example, 10 to 60 meters, endless ink ribbon in the cassette, and another type of ink ribbon cassette includes a relatively short, for example, 0.5 to 1 meters, endless ink ribbon in the cassette. In the latter case, an ink supply means is incorporated in the cassette and the ink ribbon is repeatedly used with the supply of ink thereon.

For example, Japanese Unexamined Patent Publication (Kokai) No. 63-182174 discloses an ink ribbon cassette in which an inking roller having ink absorbed therein and an ink transferring roller is provided in the cassette to supply ink onto the ink ribbon.

Japanese Unexamined Patent Publication (Kokai) No. 1-198379 discloses an ink ribbon cassette in which an inking roller is shown in FIG. 3. Also, FIGS. 1 and 2 of that reference show a pair of gears between which the ink ribbon is pinched and fed. An ink belt is provided in FIG. 1 therein, which is driven by one of the gears to supply ink to the ink ribbon.

Recently, an ink ribbon cassette has become known which comprises a pair of gears between which an ink ribbon 101 is pinched and fed, and ink is transferred from one of the gears to the ink ribbon, as shown in FIG. 7 attached hereto. The upper gear, for example, which transfers ink to the ink ribbon 101, is in contact with an ink supply means having ink absorbed therein, for example, a felt containing ink therein. Therefore, ink absorbed in the felt is scraped off by the upper gear gradually, and transferred to the ink ribbon 101 via the upper gear.

A problem of the above described prior art is that a concentration of ink in the ink ribbon varies due to occasional excessive supply of ink. For example, when the temperature around the felt is relatively high, the viscosity of ink in the felt becomes low and ink flows easily in the felt so that excessive ink is transferred to the ink transferring gear. Also, when the ink ribbon is idle fed and the printing head does not print letters, ink in that portion of the ink ribbon is not consumed and thereafter ink is further supplied by the ink transferring gear, resulting in an excessive ink supply. When excessive ink supply occurs, ink is filled in the spaces between adjacent teeth of the ink transferring gear and a large amount of ink is transferred to the ink ribbon locally to cause a variation of ink concentration in the ink ribbon and thereby deteriorate the quality of the typing.

SUMMARY OF THE INVENTION

The object of the present invention is to solve the above described problem and to provide an ink ribbon cassette in which ink is generally and uniformly supplied to an ink ribbon and a variation of ink concentration is mitigated.

According to the present invention, there is provided an ink ribbon cassette comprising an ink supply means having ink absorbed therein, a first rotatable gear arranged in contact with the ink supply means, a second rotatable gear arranged in engagement with the first gear, an ink ribbon pinched between the first and the second gears and driven by the first and the second gears upon rotation thereof for travelling along a path; and at least one groove arranged in the first gear for containing ink therein when ink is excessively transferred from the ink supply means to the first gear.

Preferably, the first gear has teeth and bottom lands between adjacent teeth, and wherein the groove is arranged in at least one of the bottom lands.

With this arrangement, excessive ink may be transferred to the ink transferring gear. When excessive ink adheres to the first gear due to a temperature change or idle feeding of the ink ribbon, only a portion of ink adhered at the tooth surfaces of the first gear is transferred to the ink ribbon, and the excessive ink is contained in at least one groove in the first gear and not transferred to the ink ribbon. Therefore, ink is uniformly distributed on the ink ribbon.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
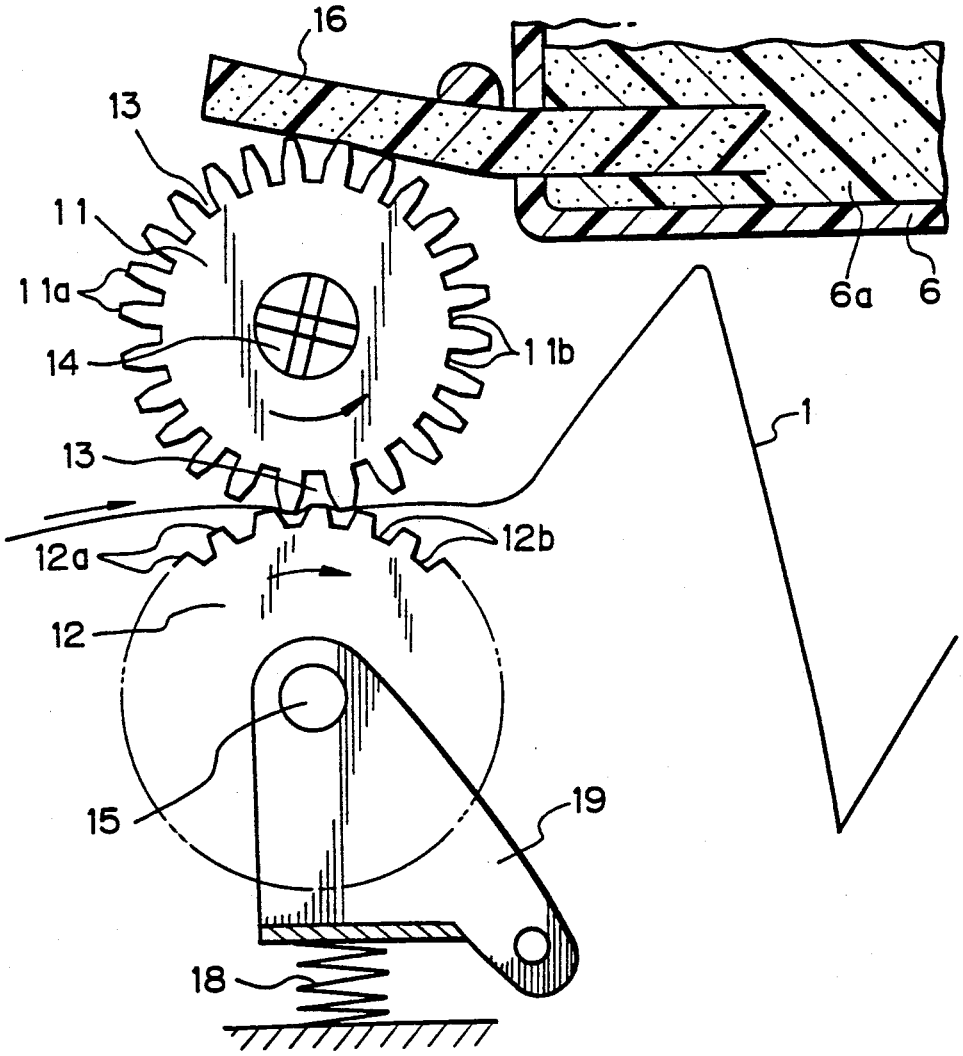
FIG. 1 is a partially cross-sectional view of an ink ribbon cassette according to the embodiment of the present invention, and showing a portion of FIG. 2 in a larger scale.
Figure 2:
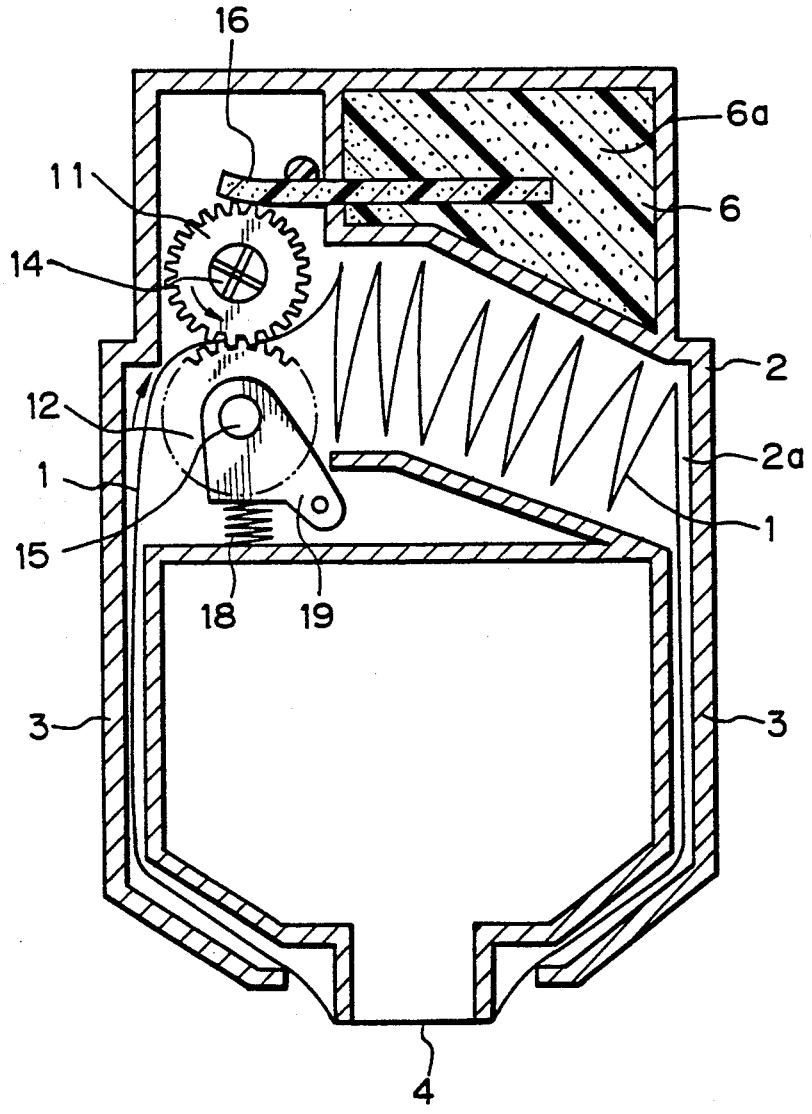
FIG. 2 is a cross-sectional view of the ink ribbon cassette according to the embodiment of the present invention.

FIGS. 1 and 2 show an ink ribbon cassette used in an impact dot printer. The ink ribbon cassette comprises a cassette case 2 having a ribbon chamber **2*a* and opposite parallel arms 3 extending from the ribbon chamber 2*a*. A head access opening 4 is provided at the ends of the arms 3. An ink ribbon 1 is a continuous and endless ribbon made of fabric, which is accommodated in the ribbon chamber 2*a* of the cassette case 2 in serpentine form and runs within a passage formed in the arms 3. The ink ribbon 1 is revealed at the head access opening 4 where a printing head (not shown) acts on the ink ribbon 1**.

The cassette case 2 includes an ink supply chamber 6 where a felt **6*a* having ink fully absorbed is arranged. A strip of ink supply felt 16 extends from the ink supply chamber 6. A pair of gears 11 and 12 are arranged in the ribbon chamber 2*a* and below the ink supply felt 16. The upper gear 11 is arranged in contact with the ink supply felt 16 and has a support shaft 14 driven for rotation by a motor not shown. The lower gear 12 has a support shaft 15 that is carried by a bracket 19. The bracket 19 is pivotally mounted to the cassette case 2 and biased by a relatively weak spring 18 so that the lower gear 12 is lightly engaged with and driven by the upper gear 11**.

The ink ribbon 1 is pinched between the upper and the lower gears 11 and 12 and driven by the upper and the lower gears 11 and 12 upon rotation thereof for traveling along the above described path, as shown by the arrows. As will be clear, the upper gear 11 scrapes ink in the ink supply felt 16 and transfers ink to the ink ribbon 1. Thus, the ink ribbon 1 can be used repeatedly, and it is possible for the ink ribbon 1 to be relatively short for example, 0.5 to 1 meters.

The upper and the lower gears 11 and 12 have teeth 11*a* and 12*a* and bottom lands 11*b* and 12*b*, respectively. The upper gear 11 also has grooves 13 for containing ink therein when ink is excessively transferred from the ink supply felt 16 to the upper gear 11. In the preferred embodiment, the grooves 13 are arranged in the bottom lands 11*b* of the upper gear 11.

Figure 6:
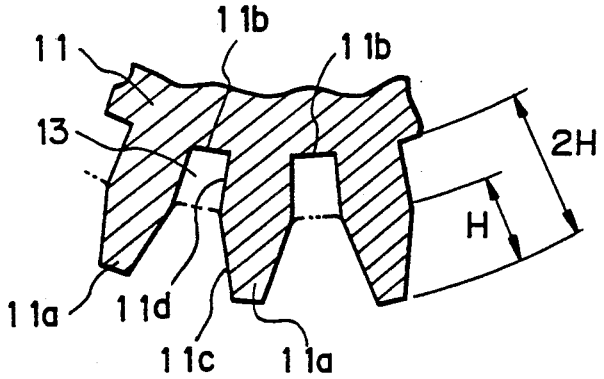
FIG. 6 is a detailed view of the upper gear of FIG. 3.
Figure 7:
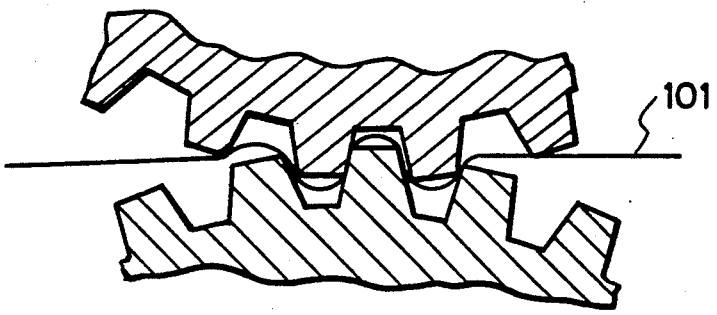
Fig. 7 PRIOR ART
FIG. 7 is a view of a prior art.

The teeth 12*a* of the lower gear 12 are formed in a standard involute tooth profile. The teeth 11*a* of the upper gear 11 are formed by a standard involute tooth profile 11*c* and a further tooth profile 11*d* contiguous to the standard involute tooth profile 11*c*, as shown in FIG. 6. The further tooth profile 11*d* is preferably a straight line and a portion of the further tooth profile 11*d* constitutes the groove 13.

Figure 5:
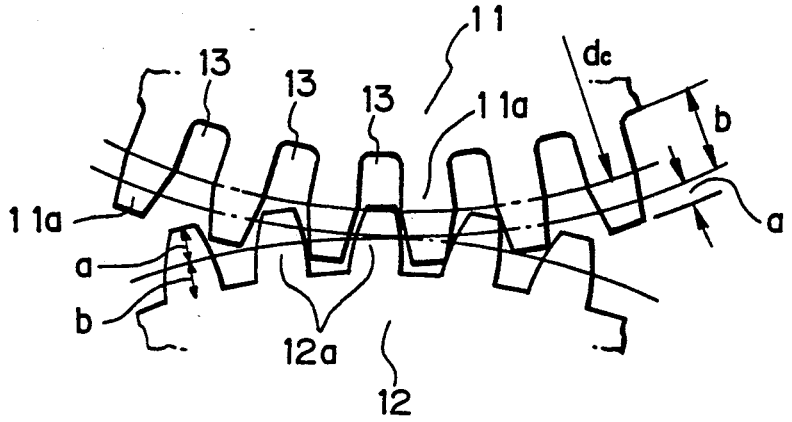
FIG. 5 is a view showing the upper and lower gears in engagement with each other.

The whole depth of the tooth is the sum of addendum "a" and dedendum "b", as shown in FIG. 5. Therefore, the whole depth of the upper gear 11 is greater than a whole depth of a standard gear. In the preferred embodiment, the whole depth of the teeth of the upper gear 11 is 2H when a whole depth of the teeth of a standard gear is H, as shown in FIG. 6. The groove 13 has a depth in correspondence with a subtraction of the whole depth of a standard gear from the whole depth of the upper gear 11 and accordingly, the depth of the grooves 13 of the upper gear 11 is H. Preferably, the depth of the grooves 13 is within a range from 0.5 to 1.5 times the whole depth of a standard (i.e., the whole depth is within a range from 1.5H to 2.5H).

In operation, the upper gear 11 and the lower gear 12 feed the ink ribbon 1, and simultaneously the upper gear 11 transfers ink to the ink ribbon 1. Thus, the ink ribbon 1 can be used repeatedly.

There may be cases where excessive ink is supplied to the ink ribbon 1. For example, when the temperature around the ink supply felt 16 is relatively high and the viscosity of the ink in the ink supply felt 16 becomes low, ink flows easily in the ink supply felt 16 so that excessive ink is transferred from the ink supply felt 16 to the upper gear 11. Alternately, when the ink ribbon 1 is idle fed and the printing head does not print letters, ink in that portion of the ink ribbon 1 is not consumed and thereafter ink is further supplied by the upper gear 11 to the ink ribbon 1.

In such cases, ink is adhered to the whole portion of teeth 11*a* of the upper gear 11 and only a portion of ink adhered at the tooth surfaces of the upper gear 11 is transferred to the ink ribbon 1. The excessive ink is contained in the grooves 13 in the upper gear 11 and this ink is not transferred to the ink ribbon 1. Therefore, ink is uniformly distributed on the ink ribbon 1. It has been found that ink contained in the grooves 13 does not drop on the ink ribbon 1 and does not cause a variation of ink concentration in the ink ribbon 1. Thus the quality of the typing or printing is ensured. It is believed that ink contained in the grooves 13 may adequately evaporate and the quality of the typing or printing is ensured during continuous use of the printer.

Figure 3:
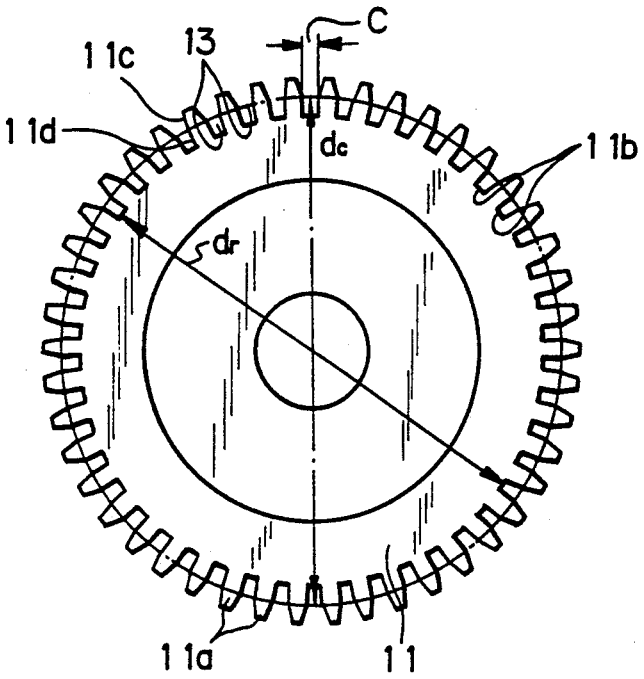
FIG. 3 is a detailed view of the upper gear of FIG. 1.
Figure 4:
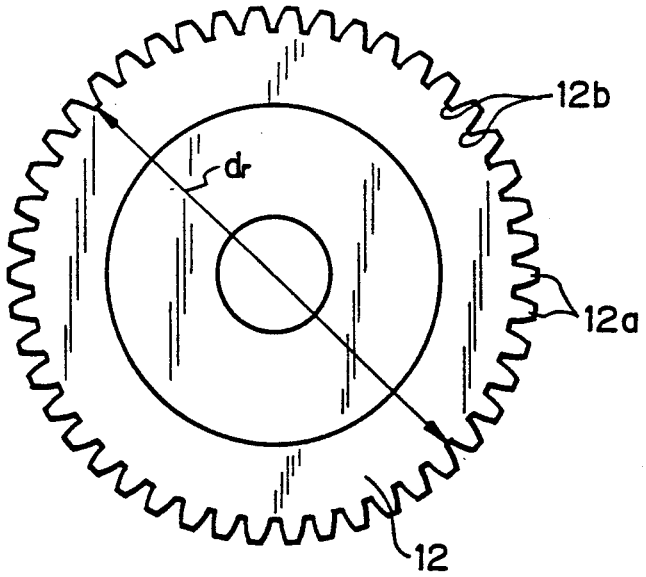
FIG. 4 is a detailed view of the lower gear of FIG. 1.

FIGS. 3 and 4 show a detailed embodiment of the upper and the lower gears 11 and 12, respectively, which have the following dimensions, where Dp is a diameter of a pitch circle, d, is a diameter of a root circle, "m" is a module, and N is a number of teeth.

| | UPPER GEAR 11 | LOWER GEAR 12 |
|---|---|---|
| Dp | 13.8 (mm) | 13.8 (mm) |
| $d_r$ | 12.45 (mm) | 13.05 (mm) |
| m | 0.3 | 0.3 |
| N | 46 | 46 |

FIG. 3 also shows a width C of the groove 13 in the upper gear 11 and a diameter $d_c$ at which a standard involute tooth profile 11*c* and a straight tooth profile 11*d* merges (and from which the groove 13 is formed by a straight line). In this example, the value of "C" is 0.4 mm and the value of $d_c$ is 13.5 mm. It should be noted that the number of teeth thereof is large with respect to the size of the upper gear 11 and the provision of the grooves 13 in this condition.

We claim:

1. An inked ribbon cassette comprising:

ink supply means having ink absorbed therein;

a first rotatable gear having a plurality of teeth and arranged to contact the ink supply means, each of said teeth of the first gear having a first tooth profile comprising an involute curve and a second tooth profile other than an involute curve contiguous to the first tooth profile;

a second rotatable gear having a plurality of teeth engaged with teeth of the first gear, each of said teeth of the second gear having a tooth profile consisting of an involute curve;

the first gear has a module identical to the module of the second gear and the depth of the teeth of the first gear is 1.5 to 2.5 times greater than the depth of the teeth of the second gear; and an ink ribbon pinched between the first and the second gears and driven by the first and the second gears upon rotation thereof for traveling along a path;

wherein the depth of the teeth of the first gear provides at least one groove between teeth of the first gear for containing ink therein when ink is excessively transferred from the ink supply means to the first gear.

2. An inked ribbon cassette according to claim 1, wherein the second tooth profile of the teeth of the first gear comprises a straight line.

* * * * *